US007182154B2

(12) United States Patent
Harrison

(10) Patent No.: US 7,182,154 B2
(45) **Date of Patent: *Feb. 27, 2007**

(54) DIRECTIONAL BOREHOLE DRILLING SYSTEM AND METHOD

(76) Inventor: William H. Harrison, 7280 Hyannis Dr., West Hills, CA (US) 91307

( * ) Notice: Subject to any disclaimer, the term of this patent is extended or adjusted under 35 U.S.C. 154(b) by 242 days.

This patent is subject to a terminal disclaimer.

(21) Appl. No.: 10/841,002

(22) Filed: May 7, 2004

(65) Prior Publication Data

US 2004/0238222 A1 Dec. 2, 2004

Related U.S. Application Data

(60) Provisional application No. 60/474,563, filed on May 28, 2003.

(51) Int. Cl.

| | |
|---|---|
| ***E21B 7/04*** | (2006.01) |
| ***E21B 10/20*** | (2006.01) |
| ***E21B 44/00*** | (2006.01) |
| ***E21B 47/02*** | (2006.01) |

(52) U.S. Cl. ..... 175/61; 175/26; 175/45; 175/73

(58) Field of Classification Search ..... 175/61, 175/26, 45, 73, 76, 263, 267
See application file for complete search history.

(56) References Cited

U.S. PATENT DOCUMENTS

| | | | | |
|---|---|---|---|---|
| 6,349,778 | B1 * | 2/2002 | Blair et al. | 175/73 |
| 6,450,269 | B1 * | 9/2002 | Wentworth et al. | 175/61 |
| 6,484,819 | B1 | 11/2002 | Harrison | 175/61 |
| 6,691,804 | B2 | 2/2004 | Harrison | 175/61 |

* cited by examiner

*Primary Examiner*—William Neuder
(74) *Attorney, Agent, or Firm*—Koppel, Patrick & Heybl

(57) ABSTRACT

A directional borehole drilling system employs a controllable drill bit, which includes one or more conical drilling surfaces. Instrumentation located near the bit measures present position when the bit is static, and dynamic toolface when the bit is rotating. This data is processed to determine the error between the present position and a desired trajectory, and the position of one or more of the bit's leg assemblies is automatically changed as needed to make the bit bore in the direction necessary to reduce the error. The controllable drill bit preferably comprises three leg assemblies mounted about the bit's central axis, each leg having a "toed-out" axle. In response to a command signal, a lower leg translates along the bit axis to cause it to bear more of the bit weight, thus excavating more deeply over the commanded toolface sector and causing the bit to bore in a preferred direction.

30 Claims, 10 Drawing Sheets

DIRECTIONAL BOREHOLE DRILLING SYSTEM AND METHOD

This application claims the benefit of provisional patent application No. 60/474,563 to Harrison, filed May 28, 2003.

BACKGROUND OF THE INVENTION

1. Field of the Invention

This invention relates to the field of borehole drilling, and particularly to systems and methods for controlling the direction of such drilling.

2. Description of the Related Art

Boreholes are drilled into the earth in the petroleum, gas, mining and construction industries. Drilling is accomplished by rotating a drill bit mounted to the end of a "drill string"; i.e., lengths of pipe that are assembled end-to-end between the drill bit and the earth's surface. The drill bit is typically made from three toothed cone-shaped structures mounted about a central bit axis, with each cone rotating about a respective axle. The drill bit is rotated about its central axis by either rotating the entire drill string, or by powering a "mud motor" coupled to the bit at the bottom end of the drill string. The cones are forced against the bottom of the borehole by the weight of the drill string, such that, as they rotate about their respective axles, they shatter the rock and thus "bore" as the bit is turned.

Boreholes are frequently drilled toward a particular target and thus is it necessary to repeatedly determine the drill bit's position. This is typically ascertained by placing an array of accelerometers and magnetometers near the bit, which measure the earth's gravity and magnetic fields, respectively. The outputs of these sensors are conveyed to the earth's surface and processed. From successive measurements made as the borehole is drilled, the bit's "present position" (PP) in three dimensions is determined.

Reaching a predetermined target requires the ability to control the direction of the drilling. This is often accomplished using a mud motor having a housing which is slightly bent, so that the drill bit is pointed in a direction which is not aligned with the drill string. To affect a change of direction, the driller first rotates the drill string such that the bend of the motor is oriented at a specific "toolface" angle (measured in a plane orthogonal to the plane containing the gravity vector (for "gravity toolface") or earth magnetic vector (for "magnetic toolface") and the motor's longitudinal axis). When power is applied to the motor, a curved path is drilled in the plane containing the longitudinal axes.

One drawback of this approach is known as "drill string wind-up". As the mud motor attempts to rotate the drill bit in a clockwise direction, reaction torque causes the drill string to tend to rotate counter-clockwise, thus altering the toolface away from the desired direction. The driller must constantly observe the present toolface angle information, and apply additional clockwise rotation to the drill string to compensate for the reaction torque and to re-orient the motor to the desired toolface angle. This trial and error method results in numerous "dog leg" corrections being needed to follow a desired trajectory, which produces a choppy borehole and slows the drilling rate. Furthermore, the method requires the use of a mud motor, which, due to the hostile conditions under which it operates, must often be pulled and replaced.

SUMMARY OF THE INVENTION

A system and method of drilling directional boreholes are presented which overcome the problems noted above. The invention enables a desired drilling trajectory to be closely followed, so that a smoother borehole is produced at a higher rate of penetration.

The invention employs a controllable drill bit, which preferably includes three leg assemblies, at least one of which consists of an upper leg that rigidly attaches to the bit frame, and a lower leg that is constrained to the upper leg by two guide rods that allow it unidirectional movement parallel to the bit axis. The lower leg has an attached axle at one end that carries a truncated, conical shaped, rotating drilling mass with hardened inserts on its surface (cone). The lower leg assemblies are dynamically translated in response to respective command signals. Instrumentation located near the bit determines the error between the bit's present position and a desired trajectory, and the position of one or more of the bit's leg assemblies is automatically changed as needed to make the bit bore in the direction necessary to reduce the error. The instrumentation preferably measures present position and attitude angles when the bit is static and dynamic toolface when the bit is rotating, and stores the information along with the desired trajectory within the memory of a microprocessor contained within the system; this data is processed to determine the error between the present position and the desired trajectory.

The controllable drill bit is preferably made from three leg assemblies with rotating cones. For at least one of the leg assemblies with upper and lower legs, the lower leg may be displaced or translated with respect to the upper leg in response to a command signal. In one embodiment, the lower leg is translated longitudinally along the bit axis a small distance, preferably via hydraulic pressure acting against a piston positioned between the upper and lower legs. In another embodiment, the upper and lower legs are coupled together using a single rod or king-pin that allows the lower leg to swivel or castor. In place of a piston, a hydraulic motor acts upon the king-pin to cause the lower leg to castor from a neutral position in either a CW ("toed out") or CCW ("toed in") direction.

In the translating leg embodiment, each leg is "toed out" by an angle of approximately 5 degrees such that its cone exerts an outward radial force on the leg while it is rolling. Ordinarily, the lower leg is seated snugly against the upper leg. In response to a command signal, the lower leg is translated, thus extending it below the other two lower legs of the bit. The translated lower leg, carrying more weight than the other two, causes the bit to exert a net radial force in a preferred direction and, thus, bore in that direction.

Further features and advantages of the invention will be apparent to those skilled in the art from the following detailed description, taken together with the accompanying drawings.

DETAILED DESCRIPTION OF THE INVENTION

Borehole drilling is typically performed using a drill bit mounted to the bottom of a drill string made from lengths of pipe that are successively added at the top of the drill string as the bit bores deeper into the earth. To bore, the drill bit is rotated about a central axis, either by rotating the entire drill string (from the top end of the string), or with the use of a motor coupled directly to the drill bit. The drill bit typically consists of a frame with two or three legs with attached rolling cones that shatter the rock upon which they roll thus boring into the earth as the bit is rotated. The three cone configuration is most common and is known as a "tri-cone bit".

The present directional borehole drilling system requires the use of a "controllable" drill bit. As used herein, a controllable drill bit includes two or three leg assemblies that are dynamically displaced or made to translate along the bit axis in response to respective command signals. This capability enables the drill bit to preferentially bore in a desired direction, making the borehole drilling system, to which the bit is attached, directional.

Figure 1:
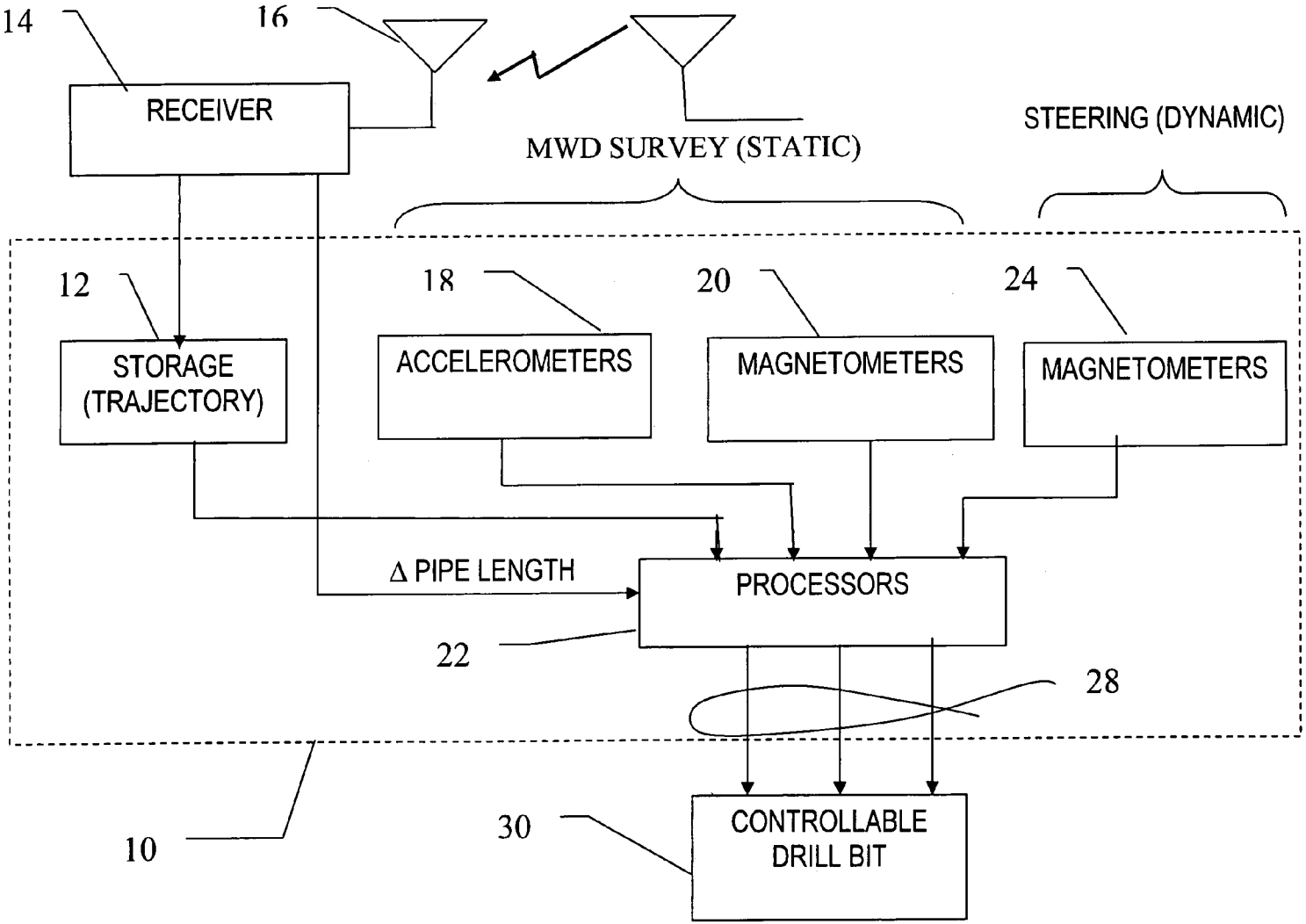
FIG. 1 is a block diagram illustrating the basic principles of the invention.

The basic elements of the directional borehole drilling system are represented in the block diagram shown in FIG. 1. A "control sonde" 10, i.e., an instrumentation and electronics package which is physically located near the drill bit, is preferably used to generate the command signals needed to achieve directional drilling. A preferred control sonde is described herein, though the invention is not limited to use with the described sonde. Any instrumentation capable of providing command signals for the controllable drill bit which reduces the error between the bit's position and its desired drilling trajectory could be used.

In a preferred control sonde embodiment, the sonde includes a storage medium 12, which may be semiconductor or magnetic memory, for example, which retains information representing a desired trajectory for the drill bit. The desired trajectory is generally determined before drilling is started. The trajectory data can be loaded into the storage medium is one of several ways: for example, it can be preloaded, or it can be conveyed to the sonde from the surface via a wireless communications link, in which case the sonde includes a signal receiver 14 and antenna 16. A third way to convey the signal would be via "mud pulse", a coded pressure modulation scheme of the drilling fluid.

To guide the bit along the desired trajectory, it is necessary to know its present position in the coordinate system in which the trajectory is expressed. Control sonde 10 preferably includes instrumentation which is used to determine present position and attitude angles while the bit is static (non-moving), as well as to determine the bit's toolface angle when the bit is rotating. Instrumentation for determining present position and attitude angles typically includes a triad of accelerometers 18 and a triad of flux-gate magnetometers 20, which measure the earth's gravity and magnetic fields, respectively. The outputs of these sensors are fed to a processor 22, which also receives information related to the lengths of pipe (Δ PIPE LENGTH) being added to the drill string, and the stored trajectory information. Pipe length information is typically provided from the surface via a communications link such as receiver 14 and antenna 16 or by "mud pulse". Data from these sources is evaluated each time the bit stops rotating, enabling the present position of the control sonde, and thus of the nearby drill bit, to be determined in three dimensions. Determination of a drill bit's present position and attitude angles in this way is known as performing a "measurement-while-drilling" (MWD) survey.

Control sonde 10 also preferably includes instrumentation for determining the bit's toolface angle while the bit is rotating. Such "dynamic" instrumentation would typically include an additional triad of magnetometers 24 that can be used to determine magnetic toolface information while the bit is rotating.

Having received the stored trajectory, present position, and dynamic toolface, processor 22 determines the error between the present position and the desired trajectory. Processor 22 then provides command signals 28 to a controllable drill bit 30 which causes the bit to bore in the direction necessary to reduce the error.

By dynamically altering the positions of one or more leg assemblies to preferentially bore in a direction necessary to reduce the error, the trajectory of the borehole is made to automatically converge with the desired trajectory. Because the trajectory corrections are made continuously within a closed-loop system while the bit is rotating, they tend to be smaller than they would be if made manually in a quasi open-loop system, i.e., with a human operator. As a result, the system spends most of its time drilling a straight hole with minor trajectory corrections made as needed. The dynamic corrections enable the present invention to require fewer and smaller "dog leg" corrections than prior art systems, so that a smoother borehole provides a higher rate of penetration (ROP), as well as other benefits that result from a "low dog leg" borehole.

Figure 2:
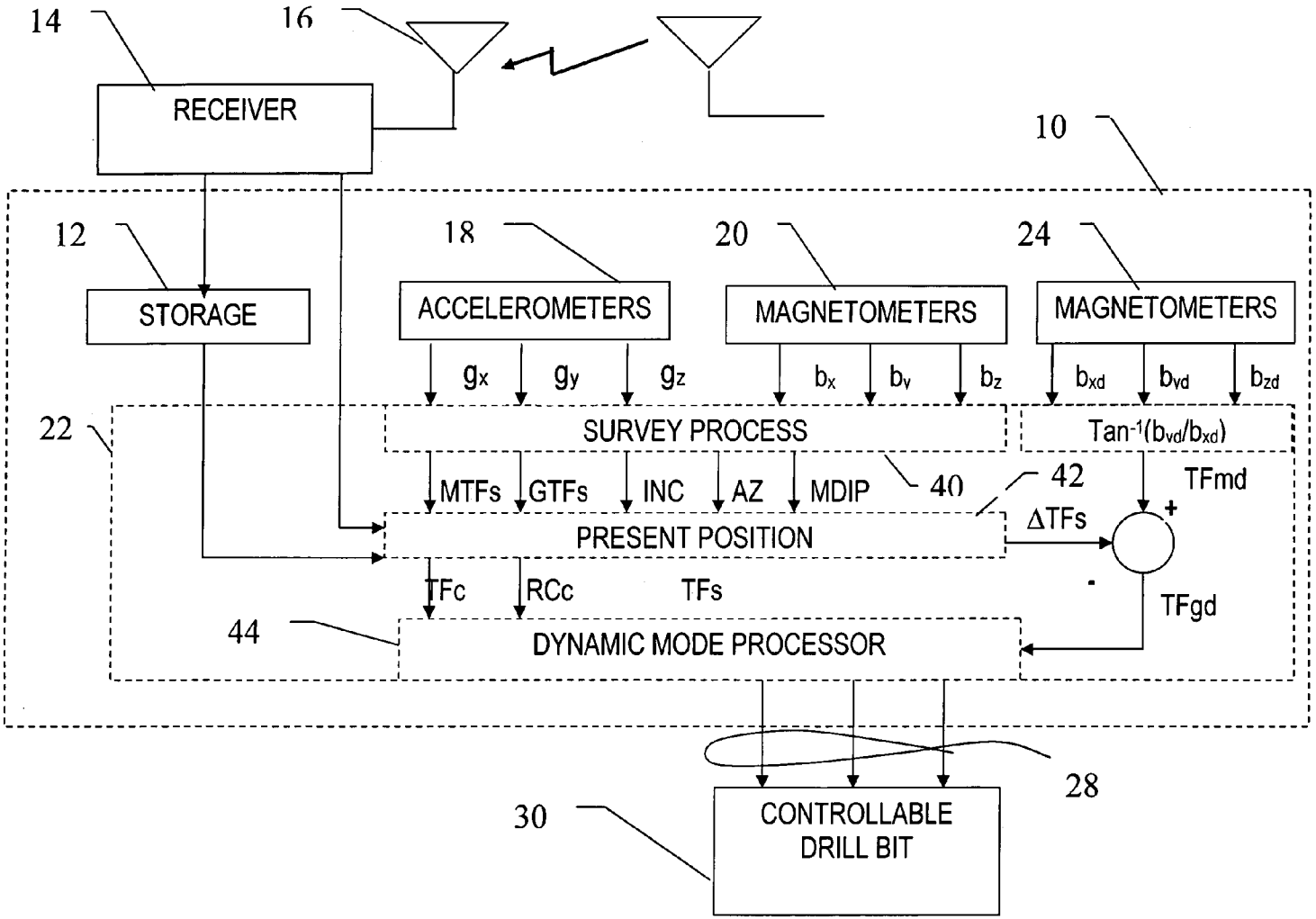
FIG. 2 is a more detailed block diagram of a directional borehole drilling system per the present invention.

A more detailed diagram of the preferred control sonde instrumentation is shown in FIG. 2. Processor 22 may be implemented with several sub-processors or discrete processors. Accelerometers 18 sense acceleration and produce outputs $g_x$, $g_y$ and $g_z$, while magnetometers 20 sense the earth's magnetic field vectors to produce outputs $b_x$, $b_y$ and $b_z$, all of which are fed to a "survey process" processor 40. Processor 40 processes these inputs whenever the drill bit is static, calculating magnetic toolface ($MTF_s$) and gravity toolface ($GTF_s$) (defined above), as well as the bit's inclination (INC), azimuth (AZ), and magnetic dip angle (MDIP). These values are passed onto a "present position processor" 42. As offset angle relationships between the sensors and the drill bit are established and included with the trajectory data, processor 42 combines this information with the above parameters and the Δ PIPE LENGTH data to determine the bit's present position (PP).

Present position processor 42 also receives the desired trajectory from storage medium 12, and compares it with PP to determine the error. Processor 42 then calculates a toolface steering command ($TF_c$) and radius of curvature command ($RC_c$) needed to reduce the error. The difference between gravity toolface $GTF_s$ and magnetic toolface $MTF_s$ changes as functions of inclination INC and azimuth AZ, both of which are changing as the sonde moves along a curved path; processor 42 thus calculates the difference, $\Delta TF_s = GTF_s - MTF_s$, and provides it as an output.

In conventional borehole drilling systems, a drill operator would be provided the PP and desired trajectory information from a system located at the rig site. From this information, he would manually determine how to reduce the error, and then take the mechanical steps necessary to do so. This cumbersome and time-consuming process is entirely automated here. The toolface steering command $TF_c$ and radius of curvature command $RC_c$ are provided to a "dynamic mode" processor 44. Processor 22 also receives dynamic inputs of $b_{xd}$, $b_{yd}$ and $b_{zd}$ from a triad of magnetometers 24, which provide magnetic toolface information as the bit is rotating. The value $TF_{md} = \tan^{-1}(b_{yd}/b_{xd})$ is calculated and summed with $\Delta TF_s$ to provide the real-time gravity toolface angle $TF_{gd}$ at the bit to processor 44.

Dynamic mode processor 44 receives the inputs identified above and generates the command signals 28 to controllable drill bit 30, with each command signal controlling a respective translated leg. If the $TF_c$ and $RF_c$ inputs indicate that a change of direction is needed, processor 44 uses the calculated value of $TF_{gd}$ to determine the positions of the leg assemblies and to issue the appropriate commands to controllable drill bit 30 to cause the leg assemblies to translate as required to cause the bit to bore in the desired direction.

Figure 3:
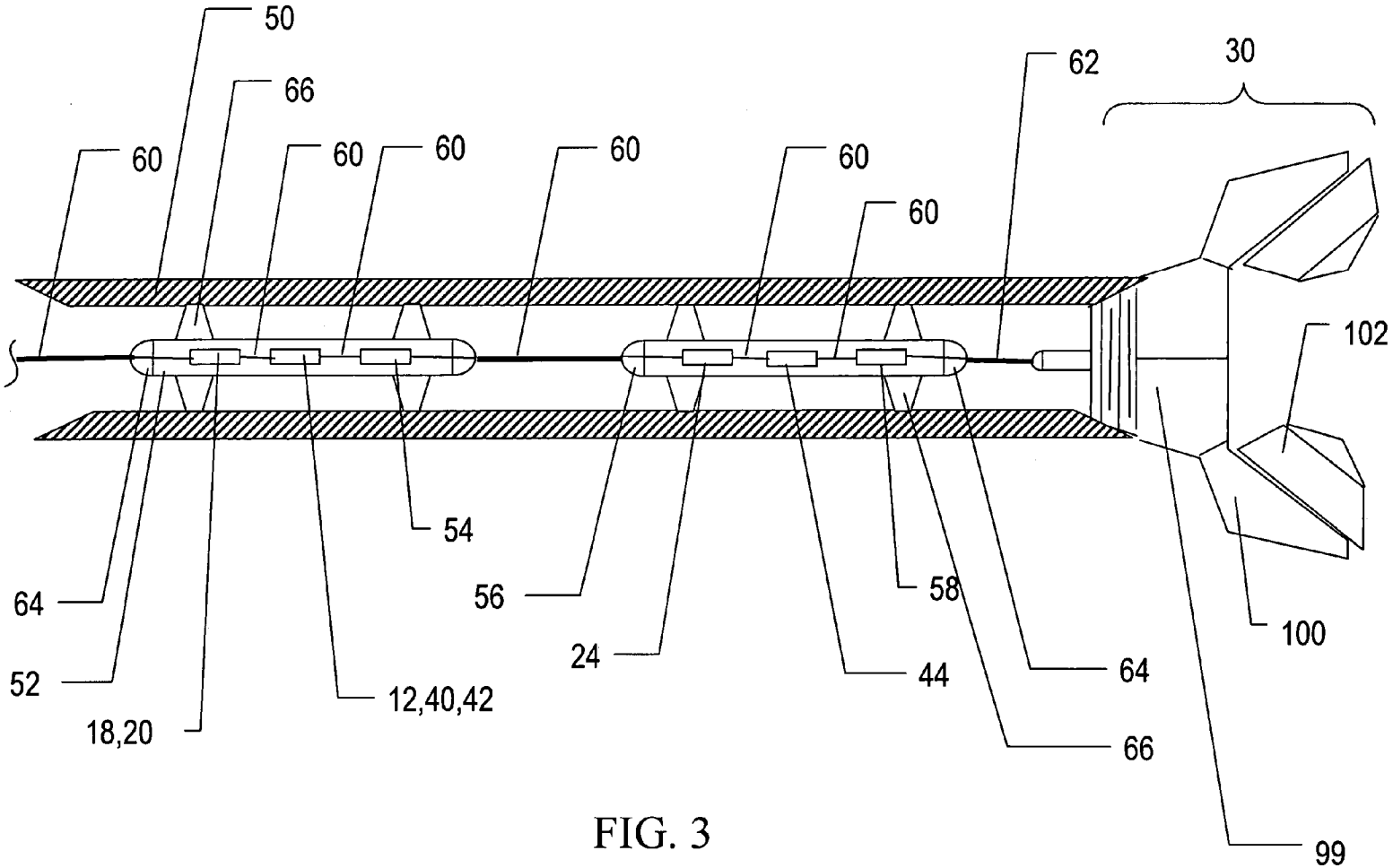
FIG. 3 is a partially cutaway view of a drill string, control sonde, and controllable drill bit.

Note that the block diagram shown in FIG. 2 is not meant to imply that all processors and instrumentation are grouped into a single package. Control sonde 10 may consist of two or more physically separated sondes, each of which houses respective instrumentation packages, and processor 22 may consist of two or more physically separated processors. One possible embodiment that illustrates this is shown in FIG. 3, which shows a cutaway view of the bottom end of a drill string 50. A first sonde 52 might contain all the "present position" equipment, such as accelerometers 18, magnetometers 20, storage medium 12 and processors 40 and 42, all powered with a battery 54; this is the functional equivalent of an MWD system. A second sonde 56 might contain all the "dynamic" equipment, such as magnetometers 24 and processor 44, powered with a battery 58. Cables 60 interconnect the separate sondes, and a cable 62 carries command signals 28 between dynamic mode processor 44 and controllable drill bit 30. Each of the sondes house their instrumentation within protective enclosures 64, and typically include spacers or centralizers 66 which keep the sondes in the center of the drill string. Note that the instrumentation and processors may be packaged in numerous ways, including an embodiment in which all of the electronics are combined into a single sonde that uses a single battery.

Magnetometers 20 and 24 might share a common set of sensors, but are preferably separate sets. The magnetometers 20 used to determine present position and attitude angles preferably have high accuracy and low bandwidth characteristics, while the magnetometers 24 used to determine dynamic position can have lower accuracy, but need higher bandwidth characteristics. This may be accomplished using sensors that are all of the same basic design, but that have processing circuits (e.g., A/D converters, not shown) having different resolution and sample rates.

The dynamic position instrumentation may include more than just magnetometers 24. When the longitudinal axis magnetometers 24 are directly in alignment with the earth magnetic field, the cross axes outputs go to zero resulting in an indeterminate value for the MTF value. To circumvent this eventuality, a set of accelerometer sensors can be added to the dynamic instrumentation; these sensors can provide additional dynamic position information when filtered with, for example, a rate gyro.

Figure 4:
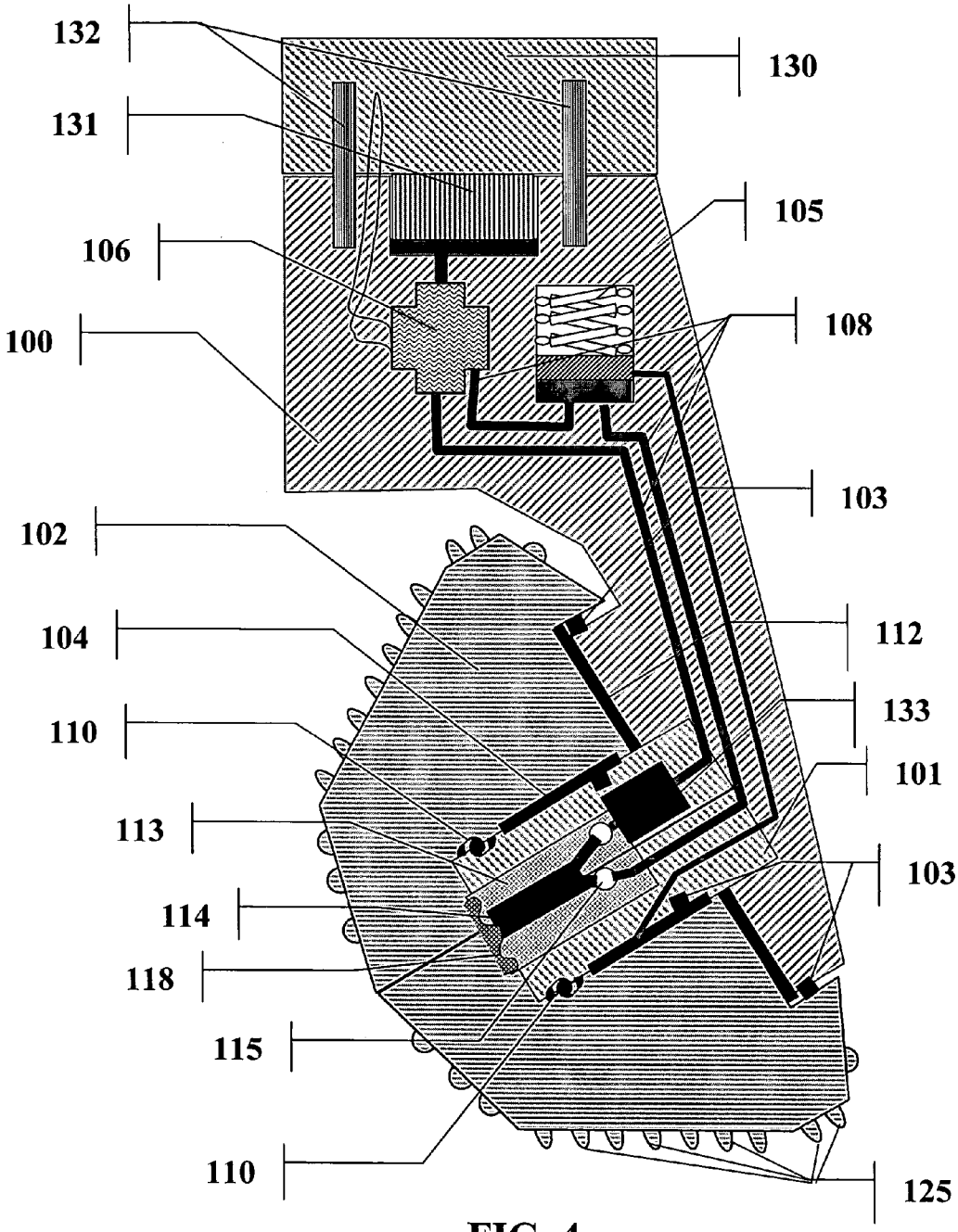
FIGS. 4 and 5 are diagrams illustrating the relationships between the upper and lower legs of a translating leg controllable drill bit when operating in its reset (normal) and translated (active) operating modes, respectively.
Figure 5:
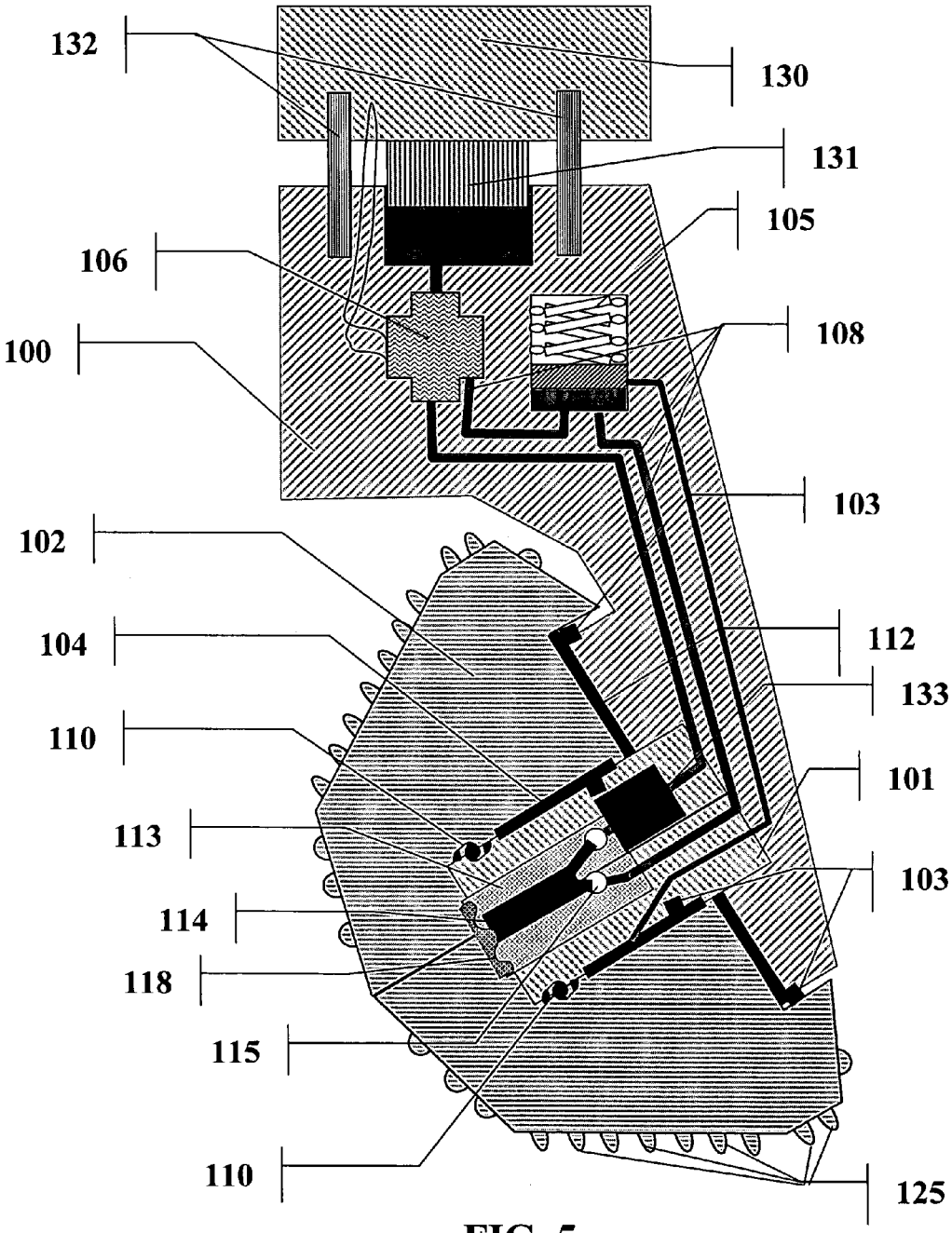

Controllable drill bit 30 may be implemented in numerous ways. One possible embodiment of bit 30 is shown in FIGS. 4 and 5 (section view of a single leg assembly) and 6 (end view); not all features are shown in all figures. The bit is made from a frame 120 having a male thread at its upper end that connects to the drill string 50 and having three equally spaced leg assemblies, at least one of which comprises an upper leg 130 mated with a lower leg 100, preferably via two guide rods 132. Each lower leg 100 carries an axle 101 that points radially inward and downward. Each lower leg also carries a cone 102 with an internal journal bearing 104 that rotates about the axle. As the bit is rotated by the drill string or motor, each cone rolls upon and fractures the rock at the bottom of the borehole.

To make the bit controllable, each leg assembly with upper and lower legs include a mechanism which, when actuated, causes its lower leg to be translated a short distance along the bit axis in response to a command signal from the control sonde. Translation is preferably achieved by injecting hydraulic fluid into a cylinder containing a piston 131 located between the upper and lower legs. The injected fluid forces the lower leg 100 to translate a fraction of an inch, moving it in a direction along the bit axis. The distance that the lower leg is allowed to translate is limited by the travel of piston 131.

The pressurized fluid also lubricates the journal bearing 104 and a thrust washer 112. The fluid is prevented from leaking out of the lower leg/cone interface space by seals 103. The fluid leaving this space is directed into a sump 133 within a pump (discussed below) to be reused. Translation of the leg assembly causes weight to be transferred to it—and off of the other two leg assemblies. When a leg assembly is not actuated, its respective lower leg 100 seats snugly against its upper leg 130.

Figure 6:
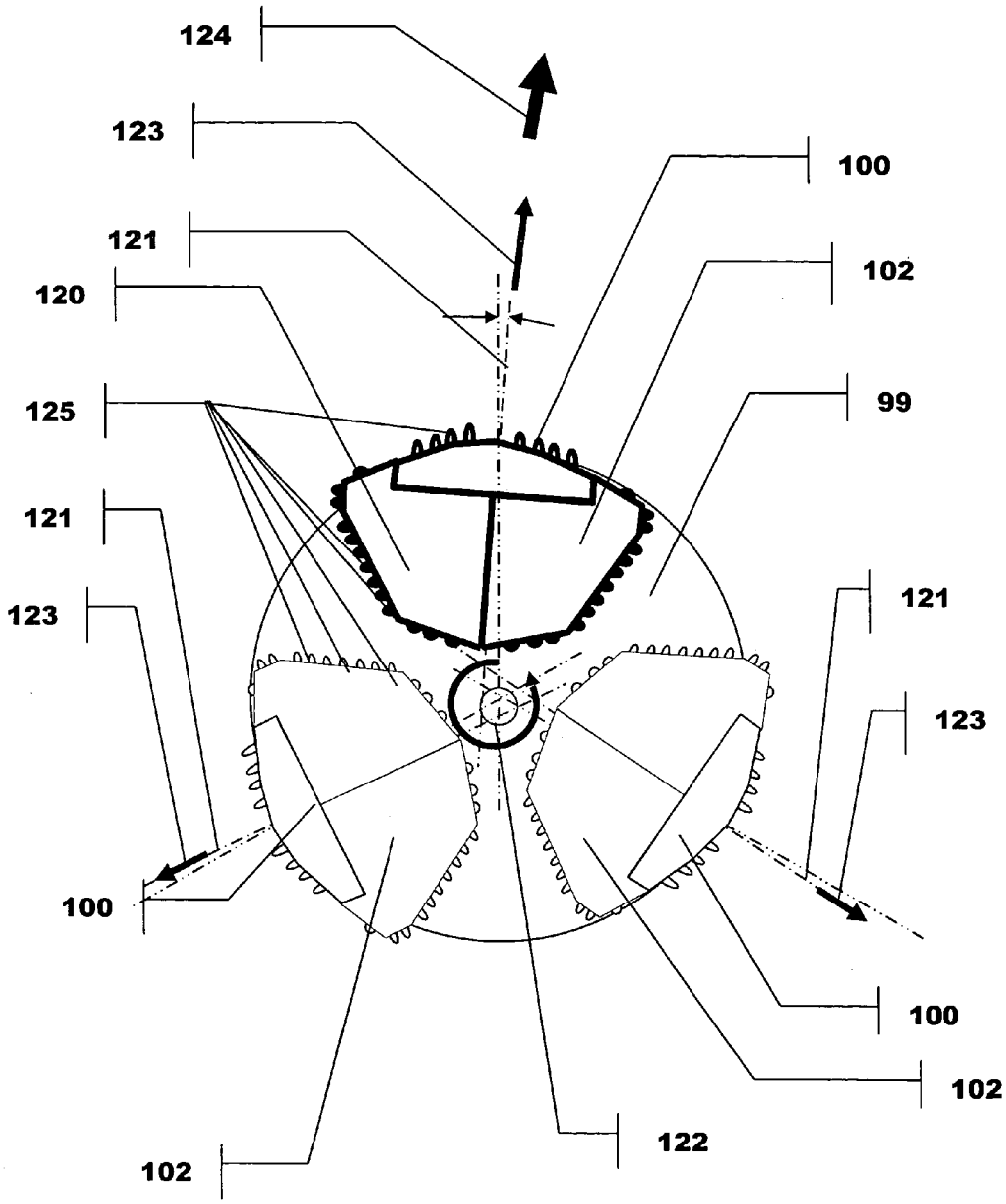
FIG. 6 is a diagram that illustrates the "toed-out" orientation cone axes relative to the longitudinal axis of the bit.

As shown in FIG. 6, the three axles are "toed-out" such that their respective axes 121 do not intersect at a common point, but each is tangent to a circle 122 centered on the longitudinal axis of the bit frame 99. The "toed-out" axles, whose axes alignments are offset from a radial projected from the longitudinal axis of the bit, preferably by approximately five degrees, cause each cone to generate an outward radial force 123 that is proportional to the weight carried by the leg. Each force acts to displace the leg in the direction of the force and thereby causes the drill string to be deflected or "steered" in the direction of the resultant (vector sum of the three force vectors 123) radial force 124 that is caused to occur over the interval of the commanded toolface angle. The rolling surface and the skirt of the cone, as well as the adjacent side area of the leg 100, are densely covered with embedded hardened inserts 125 (tungsten carbide or diamond material) that are forced against the side of the borehole thus causing excavation of the rock.

The hydraulic power used to translate the leg assemblies is generated by one or more hydraulic pumps. One method is to install a single mud turbine driven pump in the bit frame directly in the mud path in the upper part of the bit frame. This is a common device used in many downhole systems. Pressurized hydraulic fluid could be pumped into one or more accumulators to supply electro-hydraulic valves that direct the fluid to each leg assembly. Any or all of these parts may be located in the bit frame or a respective leg.

A preferred method is to use the mechanical forces inherently present at the bottom of the hole to generate hydraulic energy that is used to translate the cone. In this method, the hydraulic power generation, pressure accumulation, valving and sump are preferably contained within the leg and are independent of any shared resources. This method utilizes the rolling motion of the cone to operate a positive displacement pump 113, which is located internal to the axle 101. The pump consists of at least one cylinder, a piston 114 and pair of check valves 115. The piston 114 is driven by a face cam 118 located at the bottom of the axle bore of the cone. A hydraulic accumulator 105 and electro-hydraulic valve 106 are located in the leg body along with the interconnecting hydraulic bores 108 and sump 133. The command signal to the electro-hydraulic valve 106 originates outside of the leg assembly.

After the accumulator 105 is pressurized by the pump, hydraulic fluid is channeled to the axle/cone surfaces of the journal bearing 104 and thrust washer 112 to lubricate them and thus reduce wear and increase the life and overall reliability of the bit.

Figure 7:
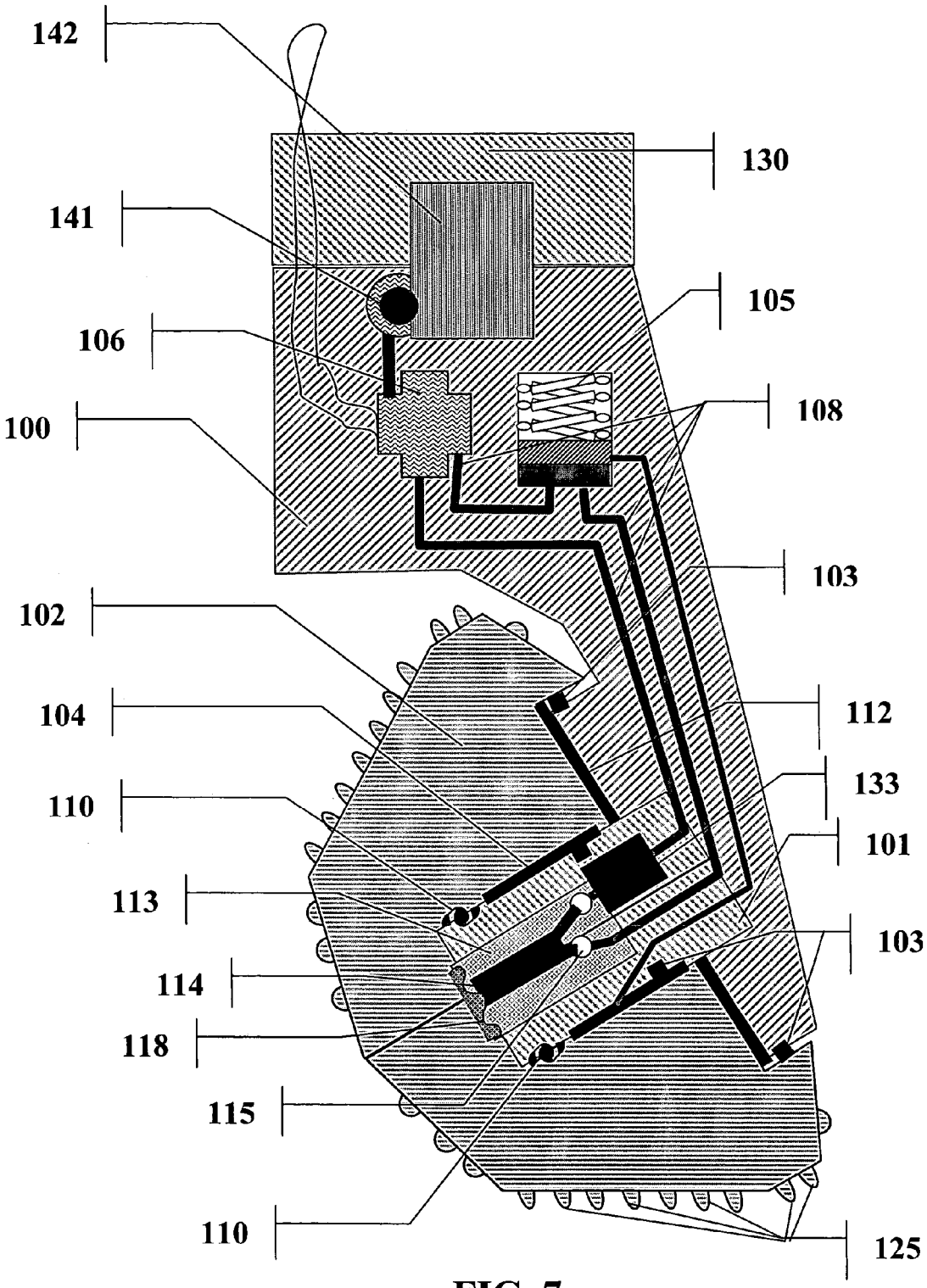
FIG. 7 is a diagram of a castoring leg controllable drill bit.

Another possible embodiment of controllable bit 30 is shown in FIG. 7, in which a castoring leg assembly is used instead of a translating leg assembly. As before, the bit is made from a frame 120 having a male thread at its upper end that connects to the drill string 50 and having three equally spaced leg assemblies, at least one of which comprises an upper leg 130 mated with a lower leg 100. Each lower leg 100 carries an axle 101 that points radially inward and downward. Each lower leg also carries a cone 102 with an internal journal bearing 104 that rotates about the axle. As the bit is rotated by the drill string or motor, each cone rolls upon and fractures the rock at the bottom of the borehole.

Most of the parts of the bit are the same as those of the translating leg implementation and they perform comparable functions. Here, however, lower leg 100 is attached to the upper leg 130 by means of a single rod or king-pin 142 that allows the lower leg to swivel or castor with respect to the upper leg. In place of a piston disposed between the lower and upper legs, a hydraulic motor 141 acts upon the king-pin to cause the lower leg to castor—typically about plus or minus five degrees from a neutral position—to affect a "toed out" or a "toed in" state. When a determination is made by the sonde to castor a lower leg, a CW or CCW command signal is provided to valve 106, which causes fluid in accumulator 105 to be channeled to hydraulic motor 141, which causes the lower leg to castor in a CW or CCW direction, respectively; here, a command signal from the control sonde should be capable of conveying one of three states: CW, CCW and neutral. With the lower leg rotated about king-pin 142, the axle 101 is other than perpendicular to the tangential velocity vector of the rolling cone, and thus generates an outward radial force (if castored in a CW direction) or inward radial force (if castored in a CCW direction). An outward-directed radial force on the rock results in the cone excavating preferentially over the commanded toolface range. Straight line drilling is resumed by commanding the valve to close, which allows lower leg 100 to return to its non-castored position.

Figure 8:
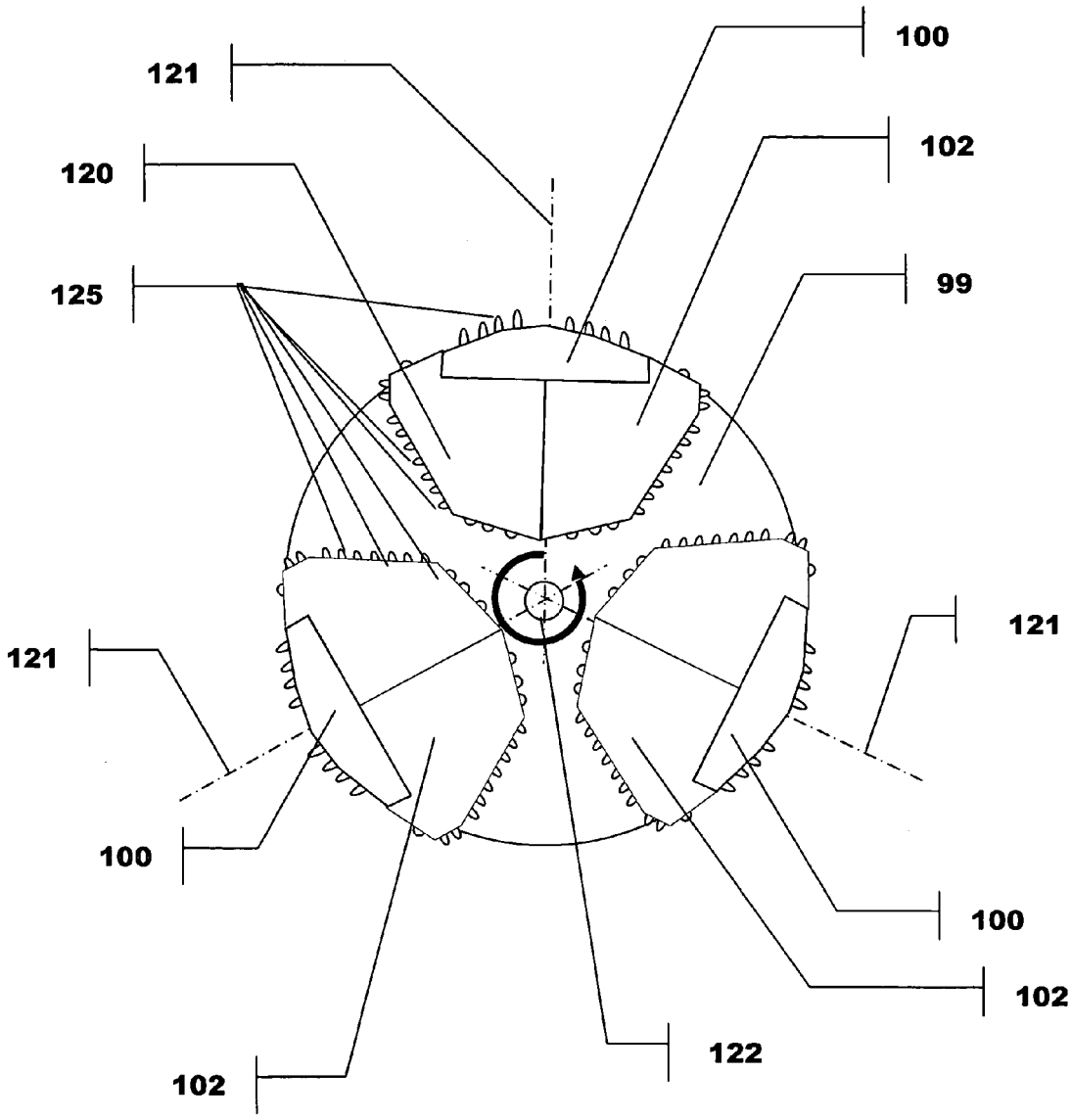
FIG. 8 is a diagram illustrating a castoring leg controllable drill bit operated at a zero castor angle.
Figure 9:
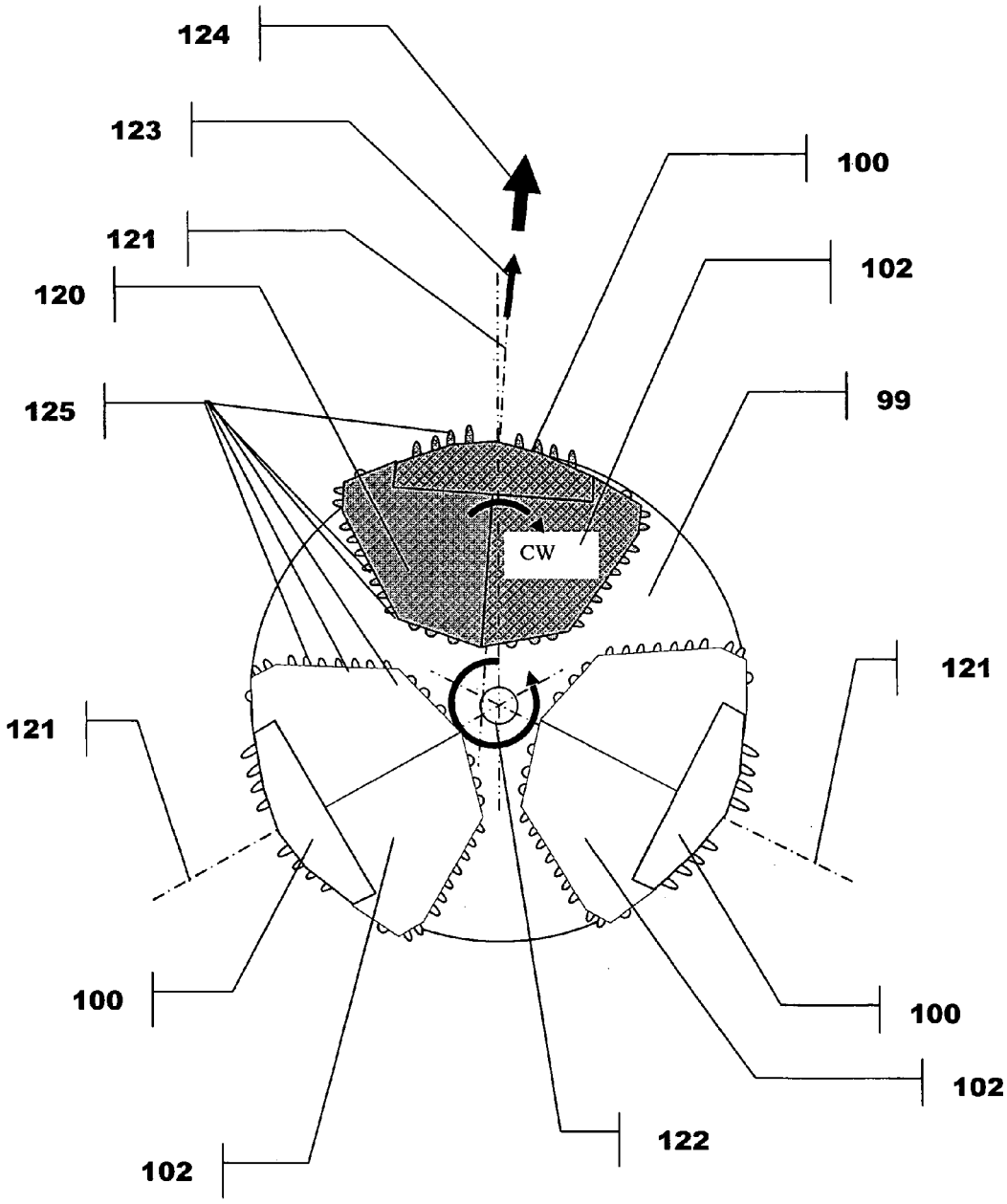
FIG. 9 is a diagram illustrating a castoring leg controllable drill bit with one leg commanded to castor in a CW direction.
Figure 10:
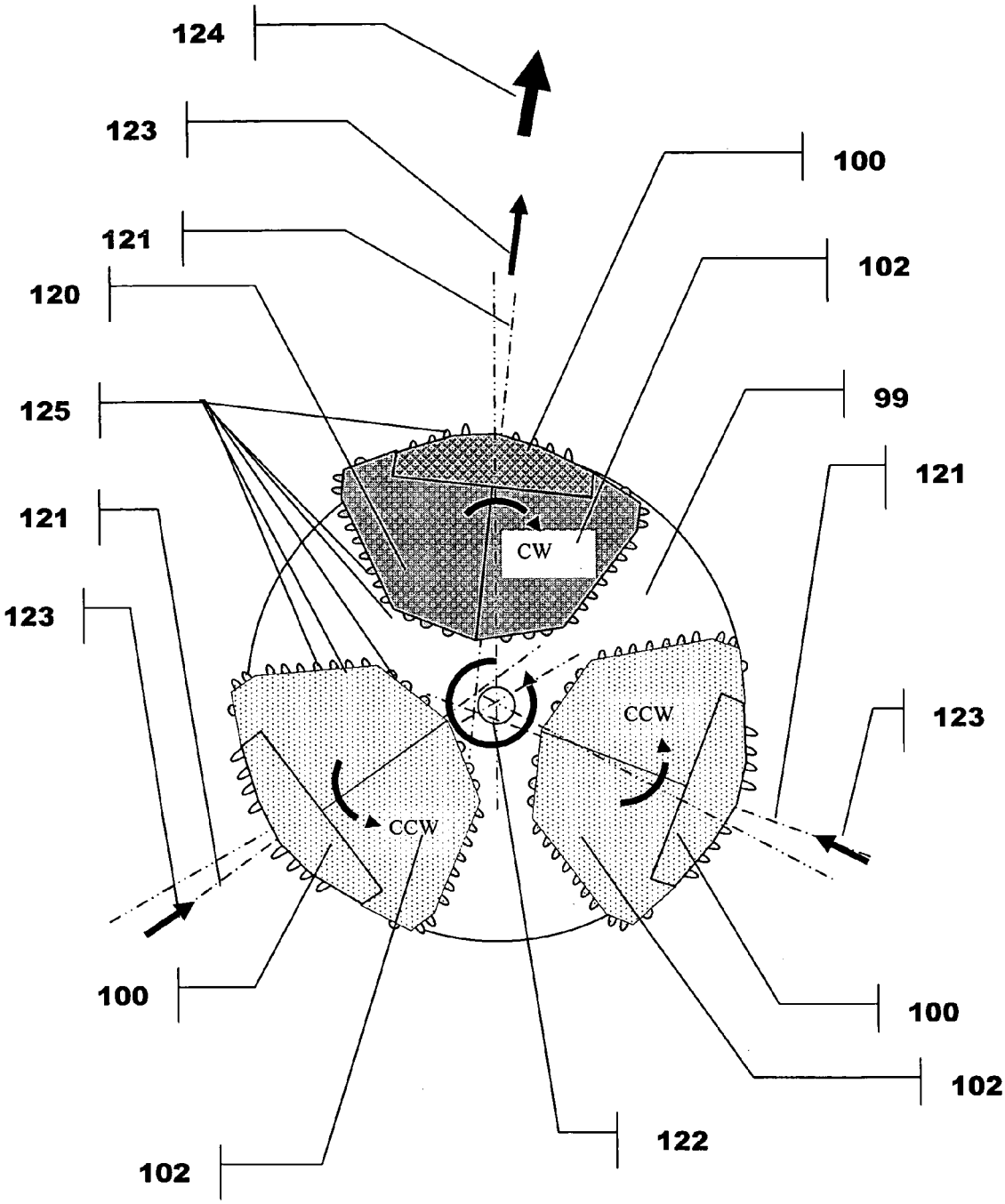
FIG. 10 is a diagram illustrating a castoring leg controllable drill bit with one leg commanded to castor in a CW direction and with two legs commanded to castor in a CCW direction.

The leg assemblies may be castored independently or in concert. In order that a single leg generates an outward radial force, it will be commanded to castor in a CW direction when viewed from below the bit, this is shown in FIG. 9. To more effectively generate the outward radial force, the other two legs may be commanded to castor in a CCW direction in order that they generate inward radial forces that supplement the outward radial force of the original leg, as shown in FIG. 10. However, most of the time the bit operates at zero castor angle, as shown in FIG. 8, wherein it drills a straight hole.

While the particular embodiments have been shown and described, numerous variations and alternate embodiments will occur to those skilled in the art. Accordingly, it is intended that the invention be limited only in terms of the appended claims.

I claim:

1. A directional borehole drilling system, comprising:

a controllable drill bit, comprising:

a plurality of leg assemblies mounted about a central axis, each of which includes a cone which rotates about a respective axle and thereby drills a borehole when said bit is driven to rotate about said central axis, each leg assembly attached to a common frame, at least one of said leg assemblies comprising:

an upper leg which is mounted to a bit frame, a lower leg which is coupled to said upper leg, and a mechanism which, when actuated in response to a respective command signal, causes said lower leg to be translated with respect to said upper leg, thereby enabling said drill bit to preferentially bore in a desired direction, and instrumentation located near said bit which determines the error between the bit's present position and a desired trajectory and provides said command signals to said controllable drill bit such that said drill bit bores in the direction necessary to reduce said error.

2. The borehole drilling system of claim 1, wherein said instrumentation is housed within at least one sonde for mounting within a drill string which is coupled to said controllable drill bit, said at least one sonde comprising:

a storage medium that contains information that represents a desired drill bit trajectory, instrumentation that determines the present position and attitude angles of said bit when said bit is in a static position, and the bit's toolface angle when said bit is rotating, and a processor that receives said present position and dynamic toolface information from said instrumentation, determines the error between said present position and said desired trajectory, and provides said command signals to said controllable drill bit such that said drill bit bores in the direction necessary to reduce said error.

3. The borehole drilling system of claim 2, wherein said instrumentation which determines present position and attitude angles comprises a plurality of accelerometers, a plurality of magnetometers, and a means for determining the length of pipe which has been added to the top end of said drill string since the previous determination of present position and attitude angles.

4. The borehole drilling system of claim 3, further comprising a transmitter located near the end of said drill string opposite said controllable drill bit with which the length of pipe added to said drill string is transmitted to said sonde, said means for determining the length of pipe added to said drill string comprising a receiver which receives said pipe length data from said transmitter.

5. The borehole drilling system of claim 4, wherein said storage medium is coupled to said receiver and said desired drill bit trajectory information is conveyed to said storage medium via said transmitter and receiver.

6. The borehole drilling system of claim 2, wherein said desired drill bit trajectory is preloaded into said storage medium.

7. The borehole drilling system of claim 1, wherein the axle of each leg of each cone assembly is "toed-out" by approximately five degrees.

8. The borehole drilling system of claim 1, wherein said controllable drill bit comprises three leg assemblies mounted about said central axis.

9. The borehole drilling system of claim 1, wherein said mechanism is arranged to effect said translation with pressurized hydraulic fluid, said mechanism comprising:

a pump for providing said pressurized hydraulic fluid, and an electro-hydraulic valve arranged to, upon receipt of a respective one of said command signals, direct said pressurized hydraulic fluid to effect said translation.

10. The borehole drilling system of claim 9, further comprising a hydraulic accumulator to store said pressurized hydraulic fluid that is supplied to said electro-hydraulic valve.

11. The borehole drilling system of claim 10, further comprising a journal bearing existent between said cone and said axle and which is lubricated by said pressurized hydraulic fluid, said hydraulic accumulator arranged to store said pressurized hydraulic fluid that is supplied to the journal bearing.

12. The borehole drilling system of claim 9, wherein said pump is located in a bore centered in said axle, said pump comprising:

at least one cylinder, a piston, and two check valves.

13. The borehole drilling system of claim 12, further comprising a face cam located and affixed to the bottom of the cone coupled to the axle containing said pump such that rotation of said cone causes said piston to reciprocate and said fluid to be pumped.

14. The borehole drilling system of claim 1, further comprising:

a drill string coupled to said controllable drill bit, and a driving means coupled to said drill string that drives said bit to rotate about said central axis, wherein said driving means comprises a motor mechanically coupled to said drill string at the end of said drill string opposite said controllable drill bit.

15. The borehole drilling system of claim 1, further comprising:

a drill string coupled to said controllable drill bit, and a driving means coupled to said drill string that drives said bit to rotate about said central axis, wherein said driving means comprises a mud motor coupled to said controllable bit.

16. The borehole drilling system of claim 1, wherein said mechanism is arranged to, when actuated, cause said lower leg to be translated along said central axis.

17. The borehole drilling system of claim 16, wherein said lower leg is coupled to said upper leg by means of two guide rods that allow said lower leg unidirectional movement parallel to the bit axis.

18. The borehole drilling system of claim 16, wherein said mechanism comprises:

a cylinder containing a piston located between said upper and lower legs, said cylinder and piston arranged such that said lower leg is translated along said central axis when pressurized hydraulic fluid is provided to said cylinder.

19. The borehole drilling system of claim 1, wherein said mechanism is arranged to, when actuated, cause said lower leg to castor in a clockwise or a counterclockwise direction with respect to said upper leg.

20. The borehole drilling system of claim 19, wherein said mechanism comprises:

a coupling means connected between said upper and lower legs which allow said lower leg to castor in a clockwise or a counterclockwise direction with respect to said upper leg, and a hydraulic motor arranged to act upon said coupling means when pressurized hydraulic fluid is provided to said motor to cause said lower leg to castor in a clockwise or a counterclockwise direction.

21. The borehole drilling system of claim 19, wherein said lower leg is coupled to said upper leg by means of a single rod or king-pin.

22. A directional borehole drilling system, comprising:

a controllable drill bit, said bit comprising:

a plurality of leg assemblies mounted about a central axis, each of which includes a cone that rotates about a respective axle and thereby drills a borehole when said bit is driven to rotate about said central axis, each leg assembly attached to a common frame and having its axle "toed out" such that the rolling cone exerts a radial force on the leg, at least one of said leg assemblies comprising:

an upper leg which is mounted to a bit frame, a lower leg which is coupled to said upper leg, and a mechanism which, when actuated in response to a respective command signal, causes said lower leg to be translated along said central axis, a drill string coupled to said controllable drill bit, a driving means coupled to said drill string that drives said bit to rotate about said central axis, and at least one sonde within said drill string that comprises:

a storage medium that contains information that represents a desired drill bit trajectory, a first instrumentation package that determines the present position and attitude angles of said bit when said bit is in a static position, a second instrumentation package that determines the dynamic toolface angle of said bit when said bit is rotating about said central axis, and a processor that receives said present position and attitude angles from said instrumentation, determines the error between said present position and said desired trajectory, and provides said command signals to said controllable drill bit such that said drill bit bores in the direction necessary to reduce said error.

23. The borehole drilling system of claim 22, wherein each of said mechanisms comprises:

a cylinder containing a piston located between said upper and lower legs, an electro-hydraulic valve assembly mounted in said mechanism's corresponding leg assembly, said valve arranged to, upon receipt of a respective one of said command signals, inject hydraulic fluid into said cylinder to cause said lower leg to translate along the bit axis thus extending its effective length when said mechanism is actuated, said lower leg resuming its normal length when said mechanism is not actuated, a hydraulic accumulator located within said mechanism's corresponding leg assembly which provides hydraulic fluid to said valve, a journal bearing existent between the cone and axle of said mechanism's corresponding leg assembly, and a positive displacement hydraulic pump located within a bore in the center of the axle of mechanism's corresponding leg assembly, said pump pressurizing hydraulic fluid stored in said accumulator to lubricate said journal bearing.

24. A directional borehole drilling system, comprising:
a controllable drill bit, said bit comprising:
a plurality of leg assemblies mounted about a central axis, each of which includes a cone that rotates about a respective axle and thereby drills a borehole when said bit is driven to rotate about said central axis, each leg assembly attached to a common frame, at least one of said leg assemblies comprising:
an upper leg which is mounted to a bit frame,
a lower leg which is coupled to said upper leg, and
a mechanism which, when actuated in response to a respective command signal, causes said lower leg to castor in a clockwise or a counterclockwise direction with respect to said upper leg,
a drill string coupled to said controllable drill bit,
a driving means coupled to said drill string that drives said bit to rotate about said central axis, and
at least one sonde within said drill string that comprises:
a storage medium that contains information that represents a desired drill bit trajectory,
a first instrumentation package that determines the present position and attitude angles of said bit when said bit is in a static position,
a second instrumentation package that determines the dynamic toolface angle of said bit and the positions of the cone assemblies coupled to said mechanisms when said bit is rotating about said central axis, and
a processor that receives said present position and attitude angles and cone assembly position information from said instrumentation, determines the error between said present position and said desired trajectory, and provides said command signals to said controllable drill bit such that said drill bit bores in the direction necessary to reduce said error.

25. The borehole drilling system of claim 24, wherein each of said mechanisms receives a command signal having clockwise, counterclockwise and neutral states, said mechanism comprising:
a coupling means connected between said upper and lower legs which allow said lower leg to castor in a clockwise or a counterclockwise direction with respect to said upper leg,
a hydraulic motor arranged to act upon said coupling means when pressurized hydraulic fluid is provided to said motor to cause said lower leg to castor in a clockwise or a counterclockwise direction,
an electro-hydraulic valve assembly mounted in said mechanism's corresponding leg assembly, said valve arranged to, upon receipt of a respective one of said command signals, provide hydraulic fluid to said motor to cause said lower leg to castor in a clockwise or a counterclockwise direction in accordance with said command signal when said mechanism is actuated, said lower leg resuming its non-castored position when said mechanism is not actuated,
a hydraulic accumulator located within said mechanism's corresponding leg assembly which provides hydraulic fluid to said valve,
a journal bearing existent between the cone and axle of said mechanism's corresponding leg assembly, and
a positive displacement hydraulic pump located within a bore in the center of the axle of mechanism's corresponding leg assembly, said pump pressurizing hydraulic fluid stored in said accumulator to lubricate said journal bearing.

26. A method of directional drilling in a borehole, comprising the steps of:
providing a controllable drill bit that comprises a plurality of leg assemblies mounted about a central axis, each of which includes a cone that rotates about a respective axle, wherein at least one of said leg assemblies comprises an upper leg and a lower leg, said lower leg able to translate with respect to said upper leg,
determining a desired trajectory for said drill bit,
determining the present position of said drill bit,
determining the error between said present position and said desired trajectory,
rotating said drill bit about said central axis,
determining the dynamic toolface angle of said bit, and causing, based on said present position, said dynamic toolface angle and at least one of said lower legs to translate with respect to said upper leg such that said drill bit bores in a direction necessary to reduce said error.

27. The method of claim 26, wherein said controllable drill bit is arranged such that said lower leg, when translated, is translated along said central axis.

28. The method of claim 26, wherein said controllable drill bit is arranged such that said lower leg, when actuated, is castored in a clockwise or a counterclockwise direction with respect to said upper leg.

29. A controllable drill bit comprising:
a plurality of leg assemblies mounted about a central axis, each of which includes a cone that rotates about a respective axle as said bit is rotated about said central axis, each of said leg assemblies comprising:
an upper leg,
a lower leg,
a mechanism coupled to said upper and lower legs which is actuated in response to a command signal, said mechanism arranged to force said lower leg to translate along the bit axis when actuated and to allow its said lower leg to rest against said upper leg when not actuated, each of said mechanisms comprising:
a cylinder and piston, wherein hydraulic fluid is injected into said cylinder to cause said lower leg to translate along the bit axis when said mechanism is actuated, and said lower leg resumes its normal length when said mechanism is not actuated,
an electro-hydraulic valve assembly mounted in said leg which provides hydraulic fluid to said cylinder when said mechanism is actuated,
a hydraulic accumulator located within said leg which provides hydraulic fluid to said valve,
a journal bearing existent between the cone and axle of said mechanism's corresponding leg assembly, and
a positive displacement hydraulic pump located within a bore in the center of the axle of said mechanism's corresponding leg assembly, said pump pressurizing hydraulic fluid stored in said accumulator to lubricate said journal bearing.

30. A directional borehole drilling system, comprising:
a controllable drill bit, said bit comprising:
a plurality of leg assemblies mounted about a central axis, each of which includes a cone that rotates about a respective axle and thereby drills a borehole when said bit is driven to rotate about said central axis, at least one of said leg assemblies comprising:
an upper leg which is mounted to a bit frame,
a lower leg which is coupled to said upper leg, and
a mechanism which, when actuated in response to a respective command signal having clockwise, counterclockwise and neutral states, causes said lower leg to castor in a clockwise or a counterclockwise direction with respect to said upper leg, each of said mechanisms comprising:

a coupling means connected between said upper and lower legs which allow said lower leg to castor in a clockwise or a counterclockwise direction with respect to said upper leg, a hydraulic motor arranged to act upon said coupling means when pressurized hydraulic fluid is provided to said motor to cause said lower leg to castor in a clockwise or a counterclockwise direction, an electro-hydraulic valve assembly mounted in said mechanism's corresponding leg assembly, said valve arranged to, upon receipt of a respective one of said command signals, provide hydraulic fluid to said motor to cause said lower leg to castor when said mechanism is actuated, said lower leg resuming its non-castored position when said mechanism is not actuated, a hydraulic accumulator located within said mechanism's corresponding leg assembly which provides hydraulic fluid to said valve, a journal bearing existent between the cone and axle of said mechanism's corresponding leg assembly, and a positive displacement hydraulic pump located within a bore in the center of the axle of mechanism's corresponding leg assembly, said pump pressurizing hydraulic fluid stored in said accumulator to lubricate said journal bearing.

* * * * *